US006117027A

United States Patent [19]

Davis et al.

[11] Patent Number: 6,117,027

[45] Date of Patent: Sep. 12, 2000

[54] SPORTS ASSEMBLY BALLAST SYSTEM

[75] Inventors: Mark E. Davis, Wauwatosa, Wis.; Michael Jiminez, Cleveland; Craig M. Saunders, Rocky River, both of Ohio

[73] Assignee: Huffy Corporation, Miamisburg, Ohio

[21] Appl. No.: 09/234,301

[22] Filed: Jan. 21, 1999

[51] Int. Cl.[7] ..... A63B 63/08

[52] U.S. Cl. ..... 473/481; 473/485; 248/519

[58] Field of Search ..... 473/476, 479, 473/481, 485, 487; 248/159, 161, 519

[56] References Cited

U.S. PATENT DOCUMENTS

| | | | |
|---|---|---|---|
| D. 264,740 | 6/1982 | Merino et al. . | |
| 2,818,254 | 12/1957 | Dunn . | |
| 3,341,197 | 9/1967 | Bottorff . | |
| 3,669,450 | 6/1972 | Mason . | |
| 3,841,631 | 10/1974 | Dolan . | |
| 3,908,992 | 9/1975 | Cunningham et al. . | |
| 4,613,136 | 9/1986 | Raba et al. . | |
| 4,759,545 | 7/1988 | Grable . | |
| 4,869,501 | 9/1989 | Anastasakis . | |
| 4,913,388 | 4/1990 | McCant . | |
| 5,145,153 | 9/1992 | Glynn . | |
| 5,158,281 | 10/1992 | Williams . | |
| 5,207,407 | 5/1993 | Fitzsimmons et al. . | |
| 5,248,140 | 9/1993 | Matherne et al. . | |
| 5,259,612 | 11/1993 | Matherne et al. . | |
| 5,354,049 | 10/1994 | Matherne et al. | 473/481 |
| 5,375,835 | 12/1994 | Van Nimwegen et al. . | |
| 5,377,976 | 1/1995 | Matherne et al. . | |
| 5,556,088 | 9/1996 | Mower et al. . | |
| 5,632,480 | 5/1997 | Davis et al. . | |

FOREIGN PATENT DOCUMENTS 29 20 903 12/1980 Germany .

*Primary Examiner*—Kien T. Nguyen
*Attorney, Agent, or Firm*—Michael J. Bell; Andrew R. Kopsidas; Howrey Simon Arnold & White, LLP.

[57] ABSTRACT

A sports assembly such as a basketball goal assembly with a removable ballast wherein the basketball goal comprises a base and a ballast component, which is separate from the base. In the assembled configuration, the ballast member preferably extends beyond the rear of the base to increase the pullover force required to topple the unit and provide more stability. A support pole preferably is mounted at the rear of the base. Thus, by extending the ballast member beyond the rear of the base, the advantage of rearwardly disposed ballast may be achieved. In order to be easily transported, the ballast component may comprise one large tank with wheels or the like, or multiple attachable tanks. In another embodiment of the invention, there is a sports apparatus ballast having two removable members which engage a structural member of the particular sports apparatus such as the pole of a basketball goal assembly.

32 Claims, 6 Drawing Sheets

SPORTS ASSEMBLY BALLAST SYSTEM

BACKGROUND OF THE INVENTION

1. Field of the Invention

The invention relates generally to portable sports assembly support ballast and, in particular, to a versatile removable ballast system which can be adapted to meet various needs of the user of the particular apparatus.

2. Description of Related Art

Various types of sports assemblies, and in particular, basketball goal support assemblies, volleyball net support assemblies and the like, have been proposed and used in the past. Such proposals have recognized that stability, and in some instances portability, are desirable characteristics. In the past, providing both stability and portability in a particular construction has come at the price of requiring a more complex structural arrangement and a larger base, which meant added complexity in manufacture, assembly and use, as well as the need for larger consumer storage space.

These problems are also present in smaller applications like poolside and youth sports products. For example, poolside systems have been developed wherein a base is adapted to sit on a pool deck and receive a first quantity of water internally and an additional quantity of water or other material externally when additional ballast is needed. However, overcoming the conflicting design considerations of stability and portability is a more difficult task in designing larger units for adults and regulation play, which must be able to withstand heavier loads and more aggressive playing conditions. Moreover, the recent trend towards using larger backboards in portable systems designed for regulation play has exacerbated these problems.

Conventionally, portable basketball systems of this type have included several main components: a basketball backboard supporting a basketball goal and a net; a pole and extension arm, elevator, or other mechanism for supporting the backboard on the pole; and a base for supporting the pole. Typically, ballast material such as water or sand is provided on top of or inside the base section to weigh down the unit, and provide the requisite stability during use. An example of a portable system having ballast inside a base is described in the assignee's prior U.S. Pat. No. 5,207,407 to Fitzsimmons et al.

In Fitzsimmons et al. '407, a hollow tetrahedral base supports the pole and has an interior space for receiving ballast material. The support pole is secured at an angle at a rear portion of the base, so that the backboard mounted on the pole extends beyond the base and over the playing surface. A roller provided in a recess on a leading edge of the base facilitates moving the unit from one location to another. While the support assembly described in Fitzsimmons et al. '407 works well and is portable, the size of the tetrahedral base makes it inconvenient to store and ship in practice.

An improvement over this portable goal assembly is described in U.S. Pat. No. 5,415,393 to Fitzsimmons et al., also developed by the assignee of this application. Like the above-described unit, Fitzsimmons et al. '393 utilizes a hollow base that is filled with ballast material and the support pole is mounted on a rear portion of the base at an angle. However, the base of Fitzsimmons et al. '393 is smaller in height and flatter than the prior tetrahedral base design. Moreover, the base is made from a single body rather than in two sections. Thus, in practice, the unit of Fitzsimmons et al. '393 is easier to ship and store than the original Fitzsimmons et al. '407 patent.

In the foregoing and other conventional goal units, achieving the greatest amount of stability, as measured by the amount of sustainable "pullover" force, should always be one of the paramount objects of a portable basketball system manufacturer. One approach to achieve this object is simply to use as much ballast as is practical. However, there are drawbacks to this approach, in that the more ballast material to be used, the larger the base must be to accommodate the ballast, which may reduce portability. In the prior designs in which the base is hollowed to receive ballast, an increase in the amount of ballast necessitates an increased interior volume for the base, which can be accomplished by increasing the surface area (i.e. the footprint) of the base and/or the height of the base. In the prior designs in which ballast sits on top of the base, it is likely necessary to provide a greater surface area for the base or to increase its strength to accommodate increased ballast. Increasing the size and/or strength of the base, in either type of design, disadvantageously increases the shipping costs, and increases the amount of consumer storage space the unit may occupy.

Additionally, when someone desires to modify their existing apparatus, the stability of the apparatus may be altered. For example, if someone were to replace the backboard of their portable basketball goal with a backboard that might be heavier than the original backboard, the stability of the assembly would be sacrificed. Accordingly, one would require more ballast than the basketball goal was originally designed to hold. The ballast should be placed in a location that would maximize the stability of the system without interfering with the use thereof.

The foregoing demonstrates that there is a need for a portable basketball support system that provides greater stability and can carry heavier loads than heretofore practical without sacrificing portability. There is also a need in the art for a ballast which is adapted to couple with a variety of sports apparatuses that is easily transported by an average individual, while still providing required stability in use.

SUMMARY OF THE INVENTION

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention consists of a portable basketball support system having a base and a ballast component, which is separate from the base. In the assembled configuration, the ballast member preferably extends beyond the rear of the base to increase the pullover force required to topple the unit and provide more stability. A support pole preferably is mounted at the rear of the base. Thus, by extending the ballast member beyond the rear of the base, the advantage of rearwardly disposed ballast may be achieved. In order to be easily transported, the ballast component may comprise one large tank with wheels or the like, or multiple removable tanks. In another embodiment of the invention, there is a sports apparatus ballast system having two removable members which engage a structural member of the particular sports apparatus such as the pole of a basketball goal assembly. In yet another embodiment of the invention, there is a ballast component which couples with an existing portable basketball goal assembly, which may have been modified, in order to maximize stability of the system.

It is an object of the present invention to provide a ballast for a sports assembly.

It is another object of an embodiment of the present invention to provide a removable ballast for a sports assembly.

It is yet another object of the present invention to provide a removable ballast for a basketball goal assembly that is easily transported when filled with ballast material.

It is still another object of the present invention to provide a removable ballast component for a basketball goal assembly that comprises multiple removable sections.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and, together with the description, serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
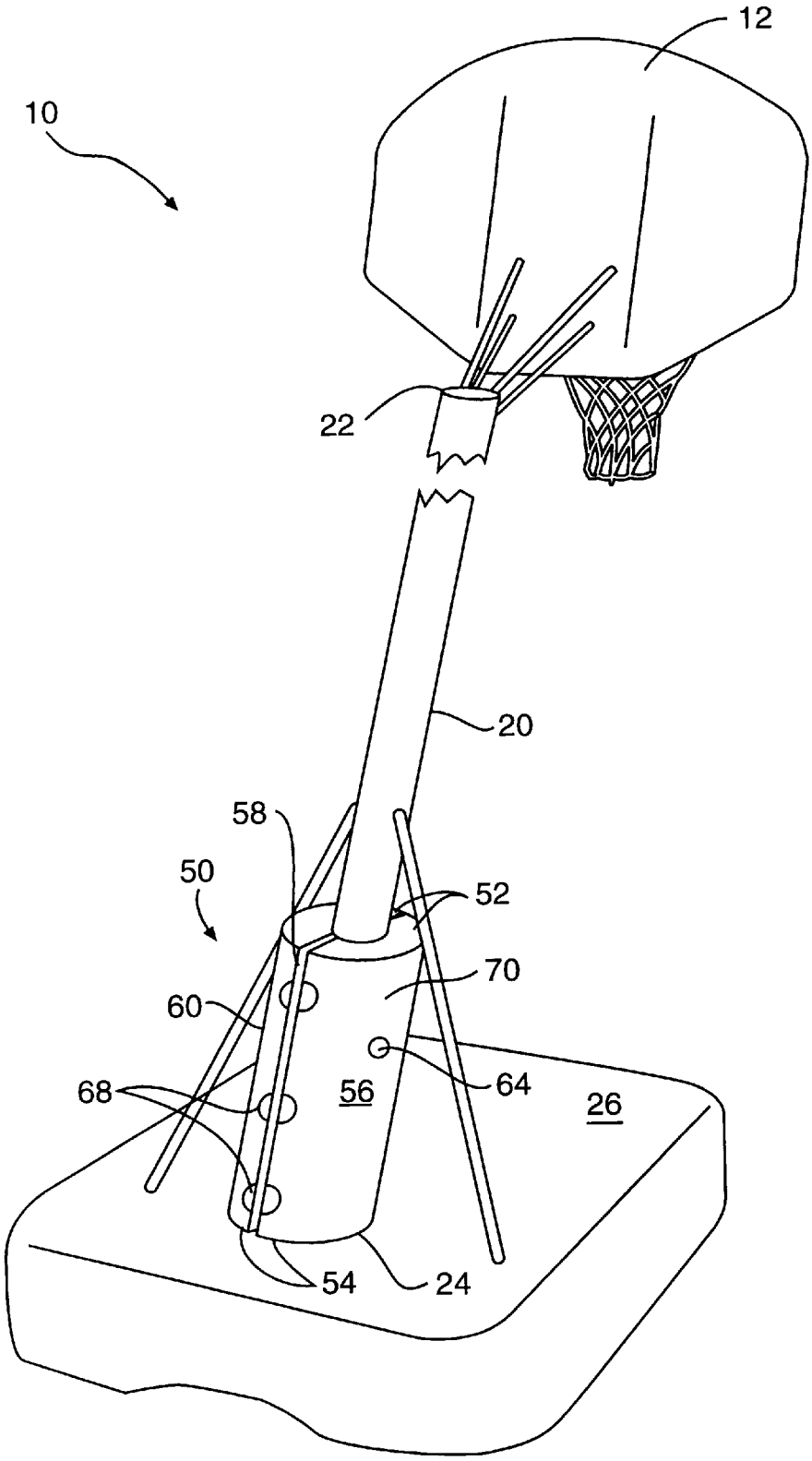
FIG. 1 is a perspective view of a sports assembly with a removable ballast.
Figure 2:
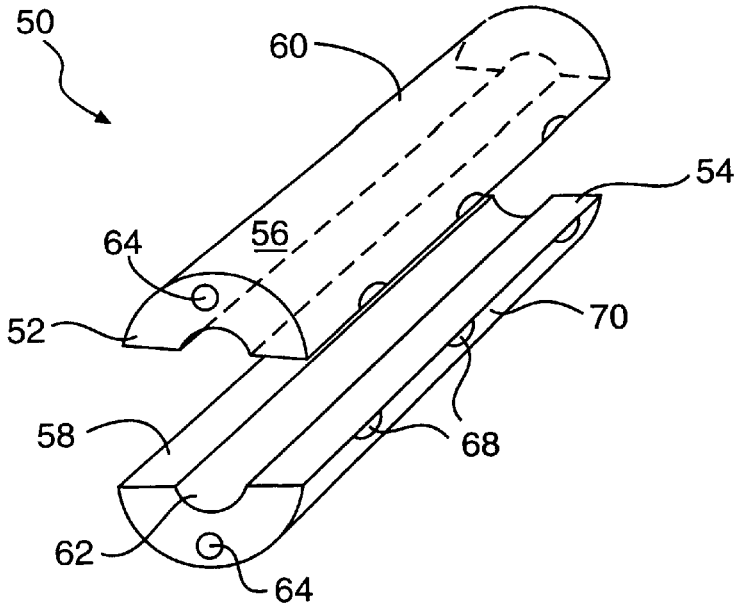
FIG. 2 is an exploded perspective view of the removable ballast shown in FIG. 1.
Figure 3:
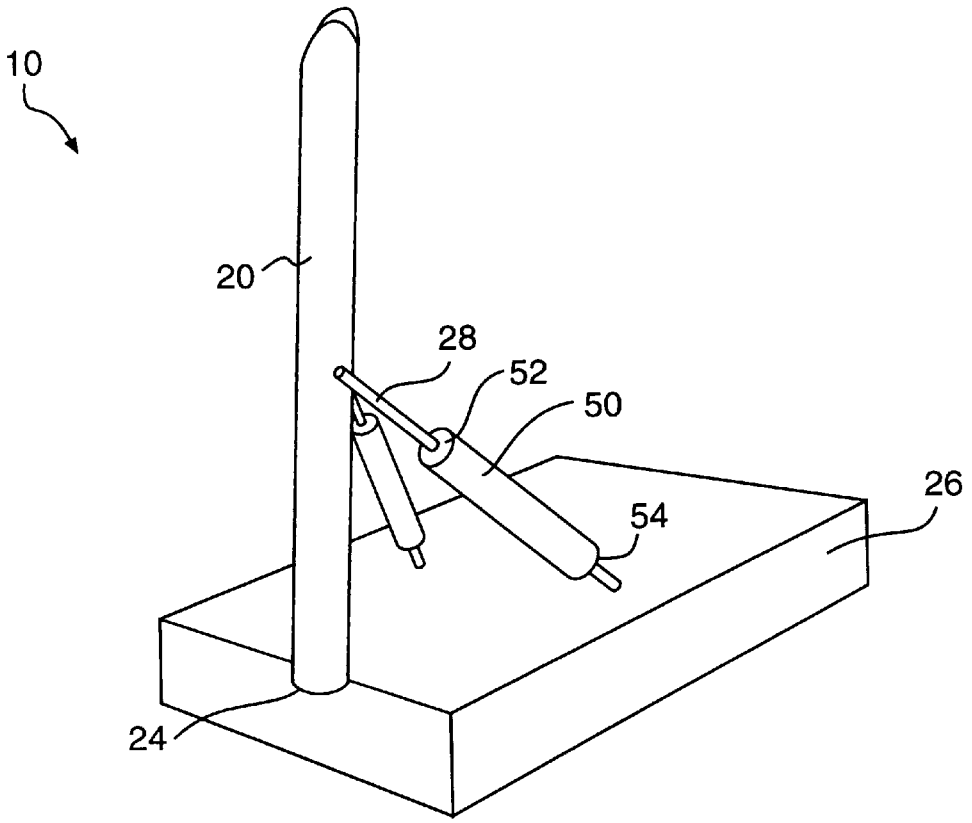
FIG. 3 is a perspective view of a sports assembly with a removable ballast as in FIG. 1, depicting the ballast in an alternative location.

An exemplary embodiment of a sports assembly with a removable ballast is shown in FIGS. 1–3 and is designated generally by reference numeral 10. As embodied herein and referring to FIG. 1, the assembly 10 includes at least one structural member 20, and a removable ballast component 50. The ballast component 50 comprises a first ballast member 60 and a second ballast member 70. Each of the ballast members has a first end 52 and a second end 54. There is a sidewall 56 extending between the first end 52 and second end 54 such that a cavity for receiving and storing ballast material, such as water and sand, (not shown) is formed. The sidewall 56 has one substantially flat surface 58 having a channel 62 therein which extends from the first end 52 to the second end 54. The sidewall 56 has a hole 64 located anywhere on its surface for filling the cavity with the ballast material. Alternatively, the hole can be located at the first end 52. There are fasteners 68, preferably complimentary interlocking fasteners or hook-and-loop type fasteners which are disposed adjacent to the substantially flat surface 58. When the fasteners 68 are joined, the substantially flat surfaces 58 of the first ballast member 60 and second ballast member 70 form a unitary construction ballast member 50 which has a bore 72 through its center. The bore 72 is adapted for engaging the structural member 20 of a sports assembly 10.

In order to facilitate the transportation of the ballast members 60, 70 it is desirable for the members to be constructed from a flexible, collapsible material. The ballast members 60, 70 can be emptied and collapsed during transportation and can be filled with ballast material in operation. Such a construction significantly reduces shipping costs and storage space requirements.

It is desirable for the ballast component 50 to be adapted to engage structural members 20 of sports assemblies 10 such as a volleyball net support pole, a portable soccer or hockey net post, a portable football goal post, a basketball support pole, or similar items. The fasteners are adjustable such that the ballast can fit structural members of various dimensions. The first ballast member 60 and second ballast member 70 are easily separated and removed such that the average person could easily transport one of the ballast members at a time, thus facilitating the transport of the entire sports assembly 10. It is desirable to attach more than one ballast component 50 to the structural member 20 or multiple structural members of the sports assembly 10.

As shown in FIG. 1 the ballast member 50 is preferably used on the pole 20 in a portable basketball goal assembly 10. The portable basketball goal assembly 10 comprises a basketball goal 12, a pole 20 having a first end 22 and a second end 24, a base member 26 and the ballast component 50. The basketball goal 12 is connected to the first end 22 of the pole 20 and the second end 24 is connected to the base member 26. Pole 20 may be substantially vertical or may be angled relative to the base member 26. Base member 26 is at least partially hollow so that it can receive and store ballast material to stabilize the pole 20. The ballast component 50 is coupled to the pole 20 near the second end 24 adjacent the base member 26 such that the weight is located near the bottom of the pole 20 in order to create the shortest moment arm possible about the assembly 10.

The ballast component 50 can alternatively be coupled to pole support members 28 of a basketball goal assembly 10 as shown in FIG. 3. The pole support member 28, which extends from the base member 26, rearward of the pole 20, to a point along the pole 20 near the second end 24. The ballast component 50, which is described above, is coupled to each of the pole support members 28 adjacent to the base member 26.

A second embodiment of the invention will now be described where like or similar parts are identified throughout the drawings by the same reference character. The second embodiment of a sports assembly with a removable ballast is shown in FIGS. 4–7 and is designated generally by reference numeral 100. As embodied herein and referring to FIGS. 4–7, the basketball goal assembly 100 includes a basketball goal 110, a pole 120 with a first end 122 and a second end 124, a support component 130 and at least one ballast component 150. The basketball goal 110 is mounted to the first end 122 of the pole 120 and the second end 124 of the pole 120 is coupled with the support component 130. The pole 120 can be inserted into the support member 130 either perpendicular to or at an angle relative to the support component 130. It is desirable to have at least one pole support member 180 which extends upwardly from the support component 130 and is coupled to the pole 120 to provide greater stability.

The support component 130 serves as the base of the basketball goal assembly 100 and is at least partially hollow for receiving and storing ballast material to stabilize the pole 120. The support component 130 comprises a raised center portion 132 for receiving the pole 120 and has an upper surface 134 and a lower surface 136 and a first side 138 and a second side 139. There are a first shelf member 140 and a second shelf member 142 each integrally formed with, and extending perpendicular to, the first side 138 and second side 139 adjacent the lower surface 136 of the raised center portion 132 respectively. The shelf members 140, 142 serve as resting points for the ballast component 150.

The ballast component 150 has a first end 152 and a second end 154 and a first surface 151 and a second surface 153. The ballast component 150 is substantially hollow for receiving and storing ballast material and is separable from the support component 130. The ballast component 150 is coupled to the support component 130 by slidably engaging the raised center portion 132. The second surface 153 of the ballast component 150 rests, at least partially, on the first shelf member 140 and second shelf member 142. The downward force of the weight of the ballast component 150 is thus conveyed to support component 130, imparting added downward force on the support component 130 to prevent inadvertent pull-over of the basketball goal assembly 100.

Figure 4:
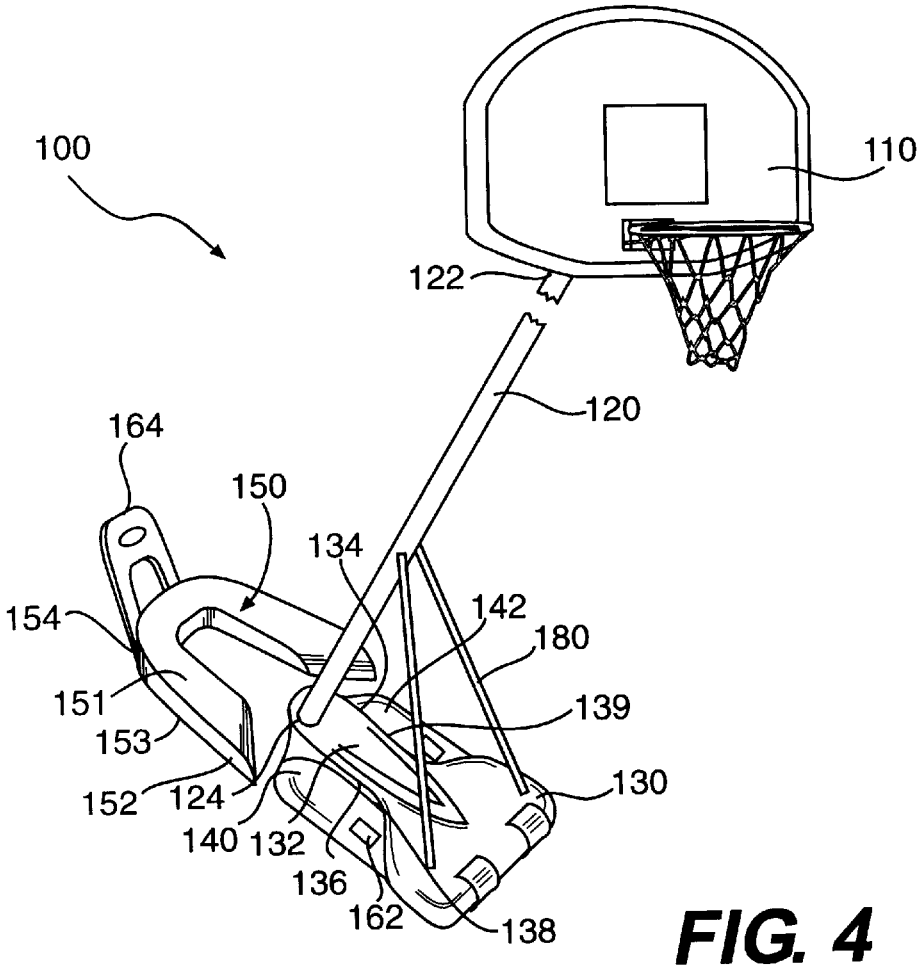
FIG. 4 is a perspective view of a second embodiment of a basketball goal assembly with a removable ballast.
Figure 5:
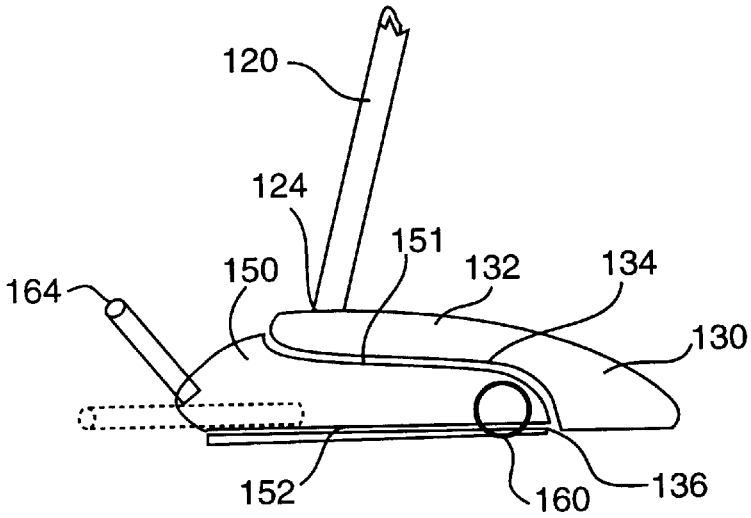
FIG. 5 is a side view of the basketball goal assembly with a removable ballast of FIG. 4.

Preferably, the ballast component 150 is a substantially u-shaped member which is adapted to substantially surround the raised center portion 132 as shown in FIGS. 4 and 5. The u-shaped ballast component 150 rests upon the first shelf member 140 and second shelf member 142. It is desirable for the ballast component 150 to be provided with at least one roller member 160 to facilitate transportation. The first shelf member 140 and second shelf member 142 are provided with recessions 162 for cooperating with the roller members 160 such that when the ballast component 150 is in place, the second surface 153 is in contact with the shelf members 140, 142. The ballast component 150 may further be provided with a handle 164 to aid in transportation. The handle 164 may be recessed on the surface of ballast component 150 or alternatively may be a handle 164 which is retractable into the ballast component 150 (see FIG. 5).

In order to facilitate the transportation of the ballast component 150 it is desirable it to be constructed from a flexible, collapsible material. The ballast component can be emptied and collapsed during transportation and can be filled with ballast material in operation.

Figure 6:
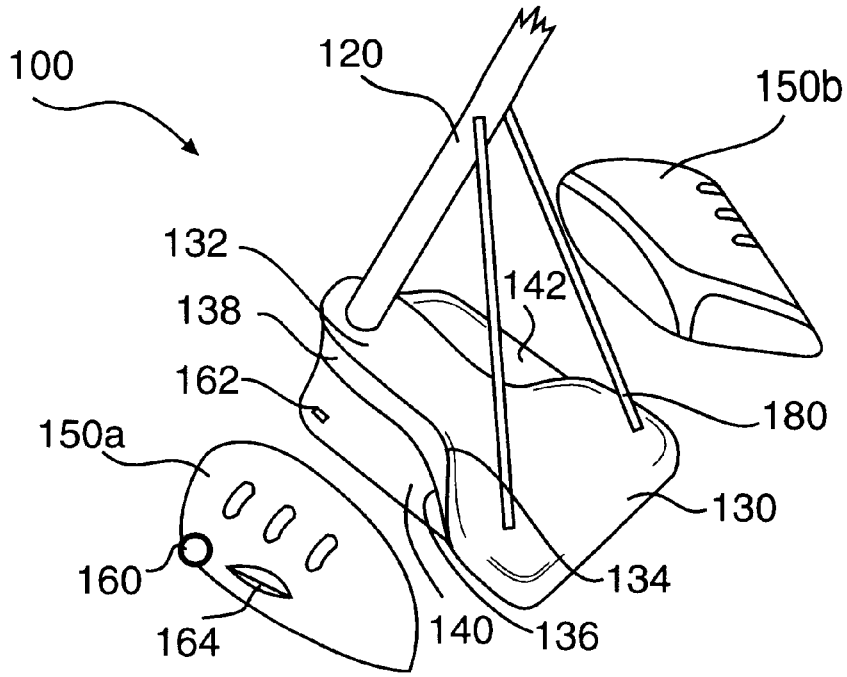
FIG. 6 is a perspective view of the basketball goal assembly with a removable ballast of FIG. 4 with an alternative removable ballast.

Alternatively, the basketball goal assembly 100 may comprise a plurality of ballast components 150. As shown in FIG. 6, the plurality of ballast components 150 are separated into a first ballast section 150*a* adapted to slidably engage the first shelf member 140 and a second ballast section 150*b* adapted to slidably engage the second shelf member 142. Each ballast section 150*a*, 150*b* comprises one ballast component 150. It is desirable for each of the ballast components 150 to be provided with at least one roller member 160 and for the first and second shelf member to have corresponding recessions 162 for cooperating with the roller members 160 as described above. It is also desirable for each of the ballast members 150 to be provided with a handle 164 as discussed above. The ballast components 150 are easily removed and transported by the average person, whether the ballast component 150 is provided with rollers 160 and a handle 164 or not. Each of the plurality of ballast components 150 may be constructed from a flexible collapsible material as described herein above.

Figure 7:
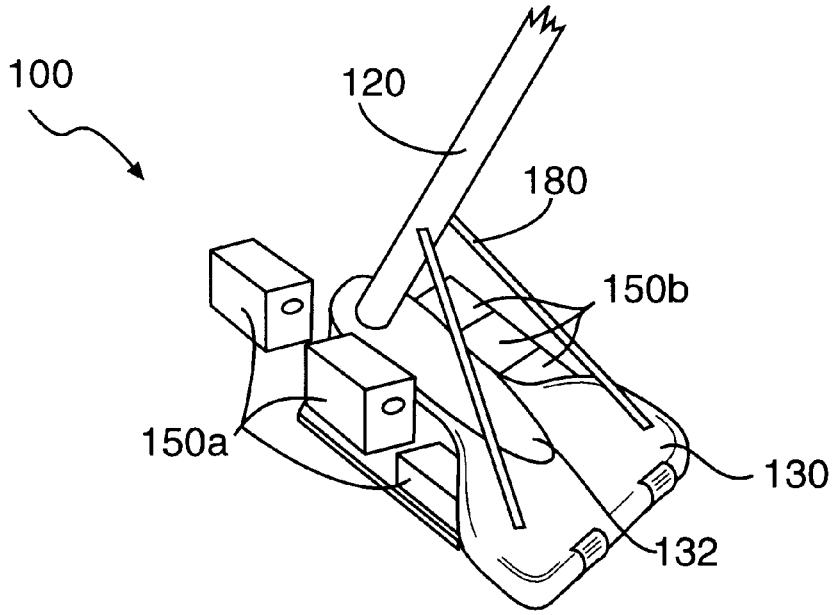
FIG. 7 is a perspective view of the basketball goal assembly with a removable ballast of FIG. 4 with another alternative removable ballast.
Figure 8:
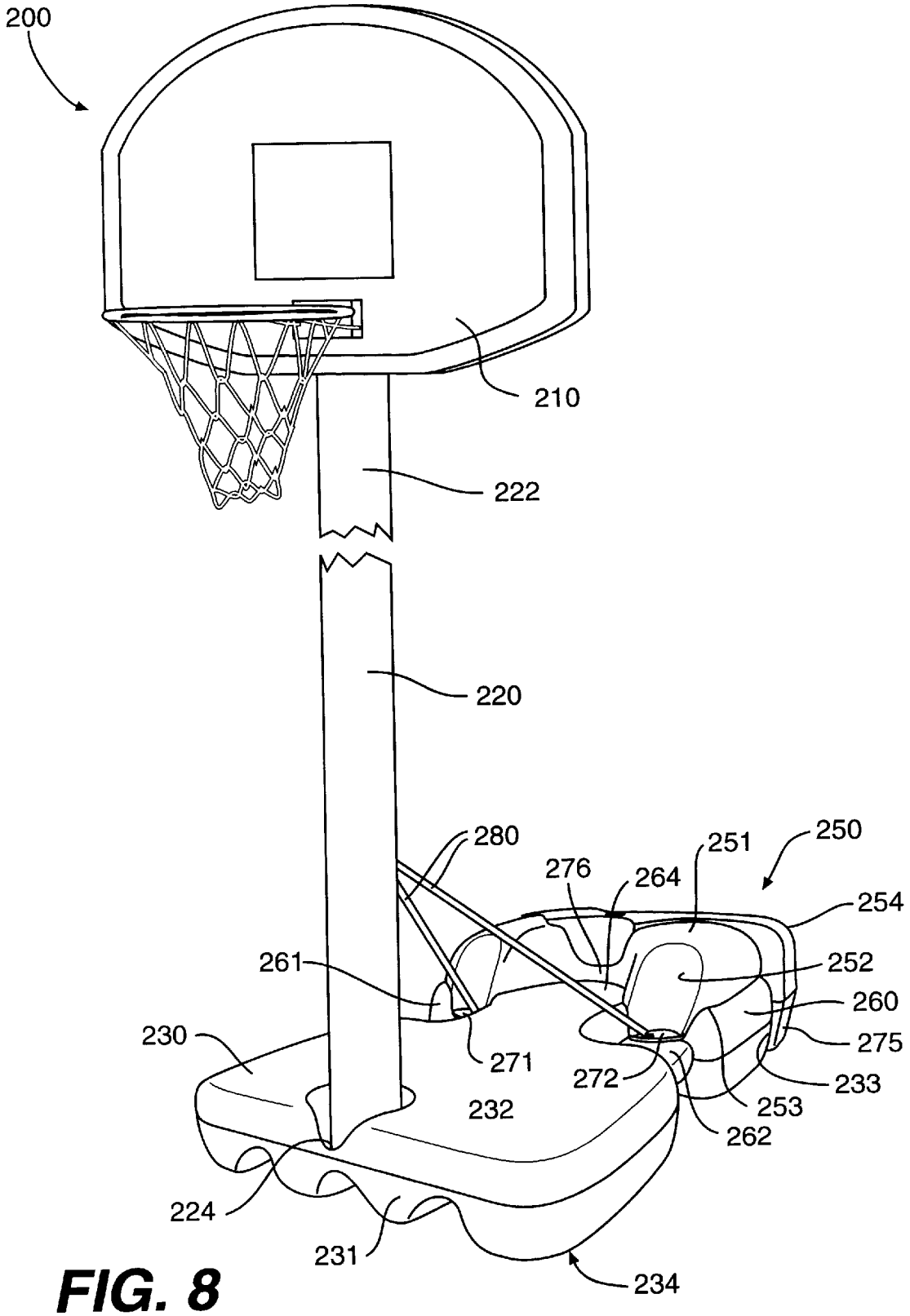
FIG. 8 is a perspective view of a third embodiment of a basketball goal assembly with an attachable ballast.
Figure 9:
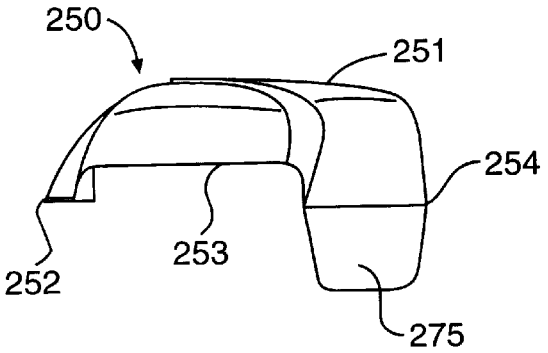
FIG. 9 is a side view of the ballast tank shown in FIG. 8.
Figure 10:
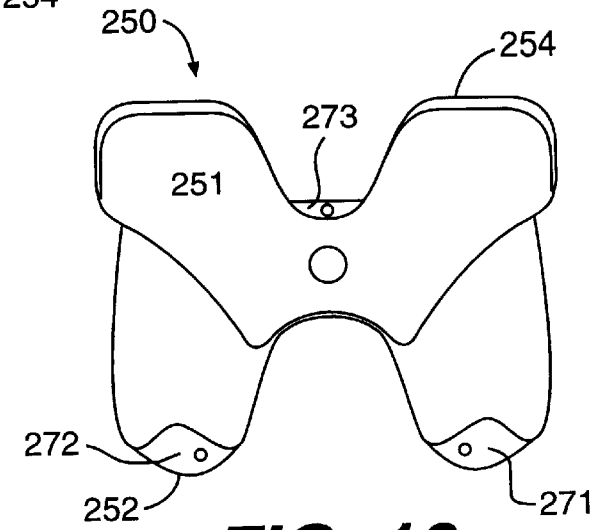
FIG. 10 is a top view of the ballast tank shown in FIGS. 8–9.
Figure 11:
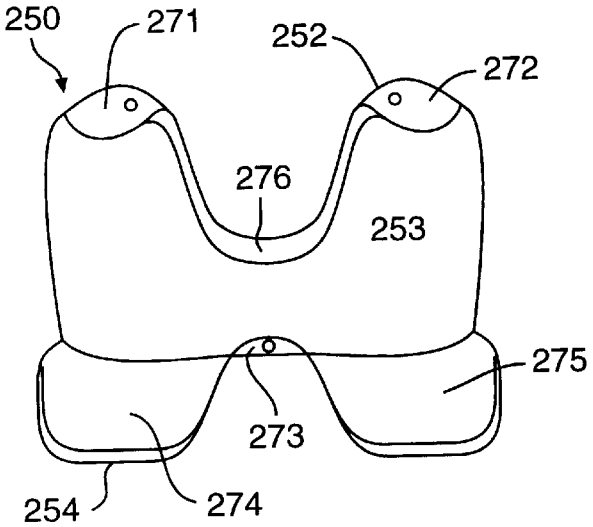
FIG. 11 is a bottom view of the ballast tank shown in FIGS. 8–10.
Figure 12:
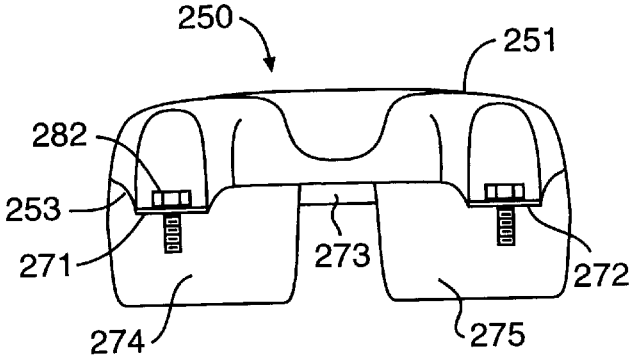
FIG. 12 is a front view of the ballast tank shown in FIGS. 8–11.

As shown in FIG. 7, the plurality of ballast components 150 are also separated into a first ballast section 150*a* adapted to slidably engage the first shelf member 140 and a second ballast section 150*b* adapted to slidably engage the second shelf member 142. Each ballast section 150*a*, 150*b* comprises multiple ballast components 150. Each ballast component 150 is dimensioned to cooperate with the shelf member and the raised center portion 132. It is desirable for each ballast component 150 to be provided with a tongue and groove assembly such that the ballast sections 150*a*, 150*b* do not readily separate during use of the assembly. The ballast components 150 are easily removed and transported by the average person, whether the ballast component 150 is provided with rollers 160 and a handle 164 or not.

A third embodiment of the invention will now be described where like or similar parts are identified throughout the drawings by the same reference character. The third embodiment of a basketball goal assembly with a removable ballast is shown in FIGS. 8–12 and is designated generally by reference numeral 200. As embodied herein and referring to FIGS. 8–12, a basketball goal assembly 200 with a removable ballast 250 is shown which comprises a basketball goal 210, a pole 220 with a first end 222 and a second end 224, a support component 230, and a ballast component 250. The basketball goal 210 is attached to the first end 222 of the pole 220.

The support component 230 has a top surface 232 and a bottom surface 234, a front end 231 and a rear end 233, where the front end 231 faces the same direction as the basketball goal 210. The support component 230 is at least partially hollow for receiving and storing ballast material to stabilize the pole 220. The support component 230 has a ballast receiving portion 260, integrally formed with, and extending upwardly from, the top surface 232 of the support component 230 adjacent the rear end 233. There is also a hole defined in the support component 230 for receiving the second end 224 of the pole 220. The ballast receiving portion 260 has a first recession 261, a second recession 262, a third recession 263 and a first flange 264 for receiving the ballast component 250. There are pole support members 280 extending upwardly from the first recession 261 and second recession 262 which are coupled to the pole 220 at a point near the second end 224.

The ballast component 250 has a first end 252 and a second end 254 and a first surface 251 and a second surface 253. There is a first projection member 271, a second projection member 272, a third projection each 273 extending downwardly from the second surface 253. A fourth projection member 274 and a fifth projection member 275 extend downwardly from the second surface 253 at the second end 254. The fourth projection member 274 and fifth projection member 275 contact and extend beyond the rear end 233 of the support component 230. There is a second flange 276 extending downwardly from the second surface 253 for engaging the first flange 264 of the support component 230. The ballast component 250 is substantially hollow for receiving and storing ballast material, such as water or sand, and is adapted to be attached to the support component 230. The second surface 253 of the ballast component 250 at least partially rests on the top surface 232 of the support component 230 such that the ballast component 250 resists motion of the basketball goal assembly 200. It is desirable for the ballast component 250 to be provided with fasteners 282 on the first, second, and third projections 271, 272, 273, for coupling the ballast component 250 to the support component 230. As described in the previous embodiments, the ballast component 250 may be constructed from a flexible, collapsible material. The ballast component can be emptied and collapsed during transportation and can be filled with ballast material in operation.

It will be apparent to those skilled in the art that various modifications and variations can be made in method of preparing a basketball goal for shipment of the present invention without departing from the spirit or scope of the invention. Thus, it is intended that the present invention cover the modifications and variations of this invention provided they come within the scope of the appended claims and their equivalents.

I claim:

1. A basketball assembly comprising:

a basketball goal;

a pole with first and second ends, said basketball goal being mounted on said first end;

a support component being at least partially hollow for receiving and storing ballast material to stabilize said pole, said support component comprising a raised center portion, having a first side and a second side, for receiving said second end of said pole, and at least one shelf member integrally formed with said support component, and extending substantially perpendicular to at least one of said first side and said second side; and at least one ballast component having a first end and a second end and a first surface and a second surface, said ballast component being separable from said support component and being substantially hollow for receiving and storing ballast, said ballast component adapted to couple to said support component by engaging said raised center portion, said second surface of said ballast component at least partially resting upon said at least one shelf member when coupled to said support component, said ballast component thereby imparting downward force on said support component.

2. The assembly of claim 1 wherein said pole is substantially vertical.

3. The assembly of claim 1 wherein said pole is angled relative to said support member.

4. The assembly of claim 1, wherein said support component is provided with pole support members extending upwardly from said support component and being coupled to said pole.

5. The assembly of claim 1, wherein said ballast component is a single, substantially u-shaped member adapted to substantially surround said raised center portion and rest upon said at least one shelf member.

6. The assembly of claim 5, wherein said ballast component is provided with at least one roller member on said second surface and said at least one shelf member is provided with a recession therein which is adapted to receive said roller member.

7. The assembly of claim 5, wherein said ballast component is provided with a handle thereon.

8. The assembly of claim 7, wherein said handle is adapted to be retracted within said ballast component.

9. The assembly of claim 7, wherein said handle is recessed in said ballast component.

10. The assembly of claim 1, wherein said at least one ballast component comprises a plurality of ballast components and wherein said at least one shelf member comprises a first shelf member and a second shelf member, each of said shelf members being integrally formed with said support component, and wherein said first shelf member extends substantially perpendicular to said first side and said second shelf member extends substantially perpendicular to said second side.

11. The assembly of claim 10, wherein each said ballast component is provided with at least one roller member on said second surface and said first and second shelf members are provided with a recession therein which is adapted to receive each said roller member.

12. The assembly of claim 10, wherein each said ballast component is provided with a handle thereon.

13. The assembly of claim 12, wherein said handle is adapted to be retracted within each said ballast component.

14. The assembly of claim 12, wherein said handle is recessed in each said ballast component.

15. The assembly of claim 10, wherein said plurality of ballast components comprises a first ballast section adapted to slidably engage said first shelf member and a second ballast section adapted to slidably engage said second shelf member.

16. The assembly of claim 15, wherein said first ballast section comprises one said ballast component and said second ballast section comprises one said ballast component.

17. The assembly of claim 15, wherein said first ballast section comprises a plurality of said ballast components and said second ballast section comprises a plurality of said ballast components.

18. The assembly of claim 10, wherein said plurality of ballast components are constructed from a flexible, collapsible material.

19. A basketball assembly comprising:

a basketball goal;

a pole with first and second ends, said basketball goal being mounted on said first end;

a support component, having a top surface and a bottom surface, a front end and a rear end, said front end facing the same direction as said basketball goal, said support component being at least partially hollow for receiving and storing ballast material to stabilize said pole, a ballast receiving portion integrally formed with said support component and disposed on the exterior of said support component, said ballast receiving portion adapted to receive a ballast component; and a hole for receiving said second end of said pole.

20. The assembly of claim 19, further comprising a ballast component configured to be received by said ballast receiving portion, wherein said ballast receiving portion has a first recession, a second recession, a third recession, a first flange for cooperating with said ballast component, and pole support members extending upwardly from said first and second recessions and being coupled to said pole near said second end.

21. The assembly of claim 20, wherein said ballast component comprises a first end and a second end, a first surface and a second surface, first, second and third projection members extending downwardly from said second surface for contacting said first, second and third recessions, fourth and fifth projection members extending downwardly from said second surface at said second end for contacting said rear end, wherein said fourth and fifth projection members extend beyond said rear end of said support member, a second flange extending downwardly from said second surface for engaging said first flange, said ballast component being attachable to said support component and being substantially hollow for receiving and storing ballast, said ballast component adapted to slidably couple to said support component, said second surface of said ballast component at least partially resting upon said support component, said ballast component thereby resisting motion of said basketball goal assembly.

22. The assembly of claim 21 wherein said first, second and third projection members are provided with fasteners for coupling said ballast component to said support component.

23. The assembly of claim 20, wherein said ballast component engages said support component by resting at least partially upon said ballast receiving portion.

24. The assembly of claim 23, wherein said ballast component partially rests upon said ballast receiving portion and wherein said ballast component extends beyond said rear end of said support component, thereby substantially enveloping said rear end of said support component.

25. The assembly of claim 20, wherein said ballast component is secured to said support component by way of at least one of bolts and screws.

26. A basketball assembly comprising:

a basketball goal;

a pole with first and second ends, said basketball goal being mounted on said first end;

a support component, having a top surface and a bottom surface, a front end and a rear end, said front end facing the same direction as said basketball goal, said support component being at least partially hollow for receiving and storing ballast material to stabilize said pole, a ballast receiving portion integrally formed with said support component, said ballast receiving portion adapted to receive a ballast component, wherein the ballast component is itself at least partially hollow for receiving and storing ballast material; and a hole for receiving said second end of said pole.

27. The assembly of claim 26, further comprising a ballast component configured to be received by said ballast receiving portion, wherein said ballast receiving portion has a first recession, a second recession, a third recession, a first flange for cooperating with said ballast component, and pole support members extending upwardly from said first and second recessions and being coupled to said pole near said second end.

28. The assembly of claim 27, wherein said ballast component comprises a first end and a second end, a first surface and a second surface, first, second and third projection members extending downwardly from said second surface for contacting said first, second and third recessions, fourth and fifth projection members extending downwardly from said second surface at said second end for contacting said rear end, wherein said fourth and fifth projection members extend beyond said rear end of said support member, a second flange extending downwardly from said second surface for engaging said first flange, said ballast component being attachable to said support component and being substantially hollow for receiving and storing ballast, said ballast component adapted to slidably couple to said support component, said second surface of said ballast component at least partially resting upon said support component, said ballast component thereby resisting motion of said basketball goal assembly.

29. The assembly of claim 28 wherein said first, second and third projection members are provided with fasteners for coupling said ballast component to said support component.

30. The assembly of claim 27, wherein said ballast component engages said support component by resting at least partially upon said ballast receiving portion.

31. The assembly of claim 30, wherein said ballast component partially rests upon said ballast receiving portion and wherein said ballast component extends beyond said rear end of said support component, thereby substantially enveloping said rear end of said support component.

32. The assembly of claim 27, wherein said ballast component is secured to said support component by way of at least one of bolts and screws.

* * * * *